United States Patent [19]

LeVoir

[11] Patent Number: 4,895,325

[45] Date of Patent: Jan. 23, 1990

[54] RAILROAD GATE ARM LAMP CIRCUIT

[75] Inventor: Donald L. LeVoir, Coon Rapids, Minn.

[73] Assignee: Safetran Systems Corporation, Minneapolis, Minn.

[21] Appl. No.: 269,296

[22] Filed: Nov. 10, 1988

[51] Int. Cl.[4] ..... B61L 5/12; B41L 9/04; H05B 41/34

[52] U.S. Cl. ..... 246/473.1; 246/125; 315/200 A

[58] Field of Search ..... 340/480–483; 246/125, 126, 127, 218, 260, 292, 293, 473 R, 473.1, 473.2, 473.3; 116/63 R; 40/612; 315/130–133, 185 R, 200 A

[56] References Cited

U.S. PATENT DOCUMENTS

| | | | |
|---|---|---|---|
| 1,989,357 | 1/1935 | Griswold | 246/473.1 |
| 2,137,196 | 11/1938 | Sampson | 246/471.3 |
| 2,203,988 | 6/1940 | Griswold | 246/471.3 |
| 3,139,556 | 6/1964 | Grentkowski | 315/200 A |
| 3,994,457 | 11/1976 | Teasel | 246/125 |
| 4,090,685 | 5/1978 | Pappas | 246/125 |
| 4,666,108 | 5/1987 | Fox | 246/125 |
| 4,703,303 | 10/1987 | Snee | 246/125 |

*Primary Examiner*—Andres Kashnikow
*Assistant Examiner*—Timothy Newholm
*Attorney, Agent, or Firm*—Kinzer, Plyer, Dorn, McEachran & Jambor

[57] ABSTRACT

A railroad crossing gate arm electrical lamp system provides two flashing lamps and one continuously operated lamp. Each of the lamps has an internal electrical circuit with the internal electrical circuits being identical for each lamp. This permits the lamps to be interchanged in position with the lamp positions determining the function of the lamp. Each lamp electricl circuit has a three-wire input connection and a three-wire output connection. There are identical and reversible three-wire cables connecting the first flashing lamp with the second flashing lamp and the second flashing lamp with the continuously operated lamp. The input for the first flashing lamp includes two power supply terminals and a third common terminal. The lamps are connected in series across the power supply and a relay alternately shunts the lamps to obtain flashing of two of the lamps. The third lamp is connected across the power supply for steady light.

3 Claims, 1 Drawing Sheet

RAILROAD GATE ARM LAMP CIRCUIT

Summary of the Invention

The present invention relates to railroad crossing gate arm electrical lamp systems and in particular to such a lamp system in which the lamps and the electrical circuits therein are all identical and interchangeable in arm position with the position on the gate arm determining the manner in which the light functions.

A primary purpose of the invention is an electrical lamp system for the use described which greatly simplifies installation procedures on railroad crossing gate arms.

Another purpose is an electrical lamp system of the type described in which the lamps are interchangeable and the electrical cables connecting the lamps are interchangeable and reversible.

Another purpose is a railroad crossing gate arm electrical lamp system in which identical lamps are positioned at the prescribed locations on a gate arm, are connected with identical cables, with the internal circuits of each lamp providing for the lamp to function in accordance with its position on the gate arm.

Other purposes will appear in the ensuing specification, drawings and claims.

Brief Description of the Drawings

The invention is illustrated diagrammatically in the following drawings wherein.

Description of the Preferred Embodiment

Figure 1:
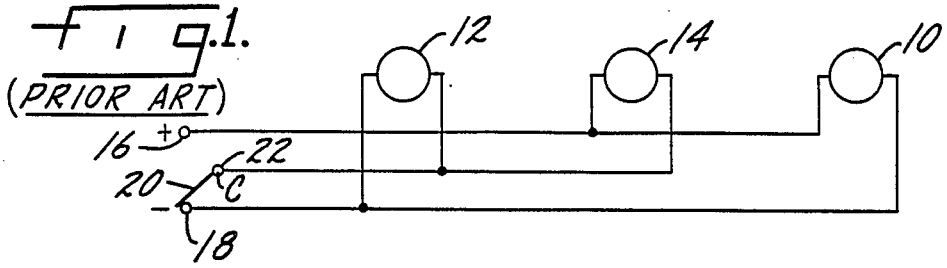
Fig. 1. (PRIOR ART)
FIG. 1 is an electrical diagram of the prior art electrical lamp system for use on railroad crossing gate arms.

Prior art electrical lamp systems for railroad crossing gate arms, typified by U.S. Pat. No. 4,666,108, require that each lamp be wired in accordance with the function of its particular position. Specifically, the tip lamp is operated continuously and the other two of the three lamps on the gate arm flash alternately. In FIG. 1, the tip lamp is indicated at 10 and the first and second flashing lamps are indicated at 12 and 14. The gate arm electrical system includes a power supply which can be either AC or DC. In a DC power supply there is a positive terminal 16 and a negative terminal 18. There is a flasher relay indicated diagrammatically at 20 which alternately connects the common terminal 22 to either the positive or negative side of the supply. As can be seen from the diagram of FIG. 1, each lamp has different connections to the positive, negative and common terminals. With the system shown, lamp 10 will be continuously lit and lamps 12 and 14 will alternately flash.

The difficulty with the prior art circuit of FIG. 1 is that each lamp must be specifically wired on the gate arm in a manner different from the other lamps. This requires the installer to take care that the lamps are properly wired or they will not function in the prescribed manner. The present invention provides identical lamps and identical connecting cables. Each lamp will function in accordance with its position on the gate arm.

Figure 2:
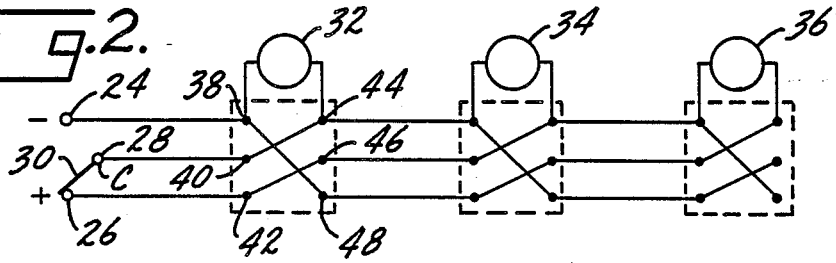
FIG. 2 is an electrical diagram of the present invention providing an electrical lamp system for railroad crossing gate arms.
Figure 4:
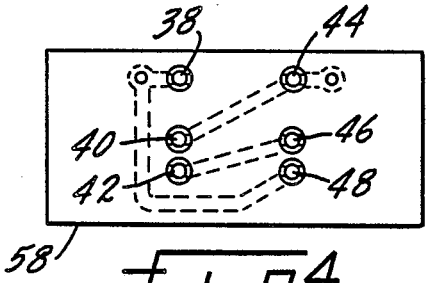
FIG. 4 is a plan view of the electrical circuit board within the lamp housing of FIG. 3.

In FIG. 2, the negative terminal of the supply is indicated at 24, the positive terminal at 26 and the common terminal at 28. A relay is indicated diagrammatically at 30. The first flashing lamp is indicated at 32, the second flashing lamp at 34, and the continuously operated lamp at 36. Each of the lamps are identical and each has an identical electrical circuit which is shown diagrammatically in FIG. 2 and in printed circuit board form in FIG. 4.

Each lamp circuit includes an input connection having three terminals indicated at 38, 40 and 42. Similarly, each lamp circuit has an output connection with three terminals indicated at 44, 46 and 48.

Figure 5:
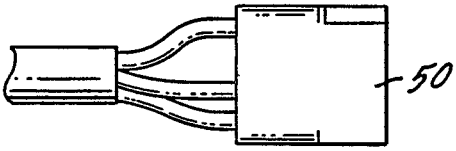
FIG. 5 is a side view of the interconnecting cable and the connector thereon.

The electrical cables connecting the two flashing lamps and lamp 34 with lamp 36 are identical and reversible. Each is a three-wire cable, as indicated in FIG. 5, and each includes a cable connector 50.

Figure 3:
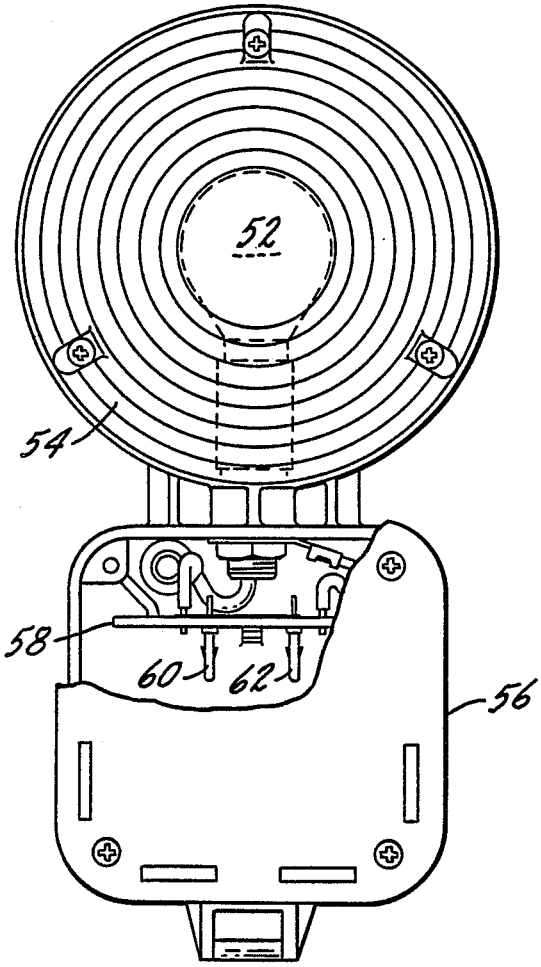
FIG. 3 is an enlarged front view of the lamp, with a portion of the lamp housing removed.
Figure 6:
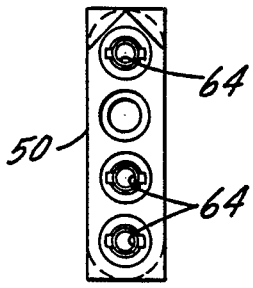
FIG. 6 is an enlarged end view of the cable connector of FIG. 5.

The mechanical configuration of each of the lamps is indicated in FIG. 3. Each lamp includes a light 52 and a lens 54 which is mechanically mounted on top of a housing or junction box 56. Within the junction box 56 is a printed circuit board 58, illustrated in FIG. 4, and having the electrical wiring shown thereon. The circuit board has input connecting pins 60 and output connecting pins 62, which pins will be received within the openings 64 in cable connector 50, as illustrated in FIG. 6. Thus, the connectors 50 are plugged onto the pins 60 or 62 to complete the input and output connections to the lamp and its electrical circuit. It is important to note that the position of openings 64 and pins 62 require that the connector be plugged onto the pins in only one way.

Each lamp light is connected to input terminal 38 and output terminal 44. The input terminals 38, 40 and 42 may be described as first, second and third input terminals and the output terminals 44, 46 and 48 may be described as first, second and third output terminals. In order for the application of power from the DC supply to cause the first and second lamps to alternately flash and the third lamp to be operated continuously, there are certain required connections between the input and output terminals. Input terminal 38 is connected to output terminal 48; input terminal 40 is connected to output terminal 44, and input terminal 42 is connected to output terminal 46.

Relay 30 will connect the common terminal to either the negative side of the DC supply indicated at 24 or the positive side of the DC supply indicated at 26. When the common terminal is connected to the positive terminal, lamp 32 will have an electrical circuit from input terminal 40, connected to battery positive, to output terminal 44, through the lamp, and then to input terminal 38, connected to battery negative. Lamp 32 will thus be operated. Lamp 34 will not be operated, as it will not have connections to the positive and negative battery terminals. One side of lamp 34 will be connected to the positive side 26 of the DC supply while the other side of lamp 34 will be connected to common terminal 28 which is connected through relay 30, also to the positive side of the supply. Lamp 36 will have its input terminal 38 connected to the positive side 26 of the DC supply and will have its output terminal 44 connected to the negative side of the DC supply. Regardless of the position of relay 30, lamp 36 will be operated, whereas, lamps 32 and 34 will alternately be connected across the battery.

It is particularly important in the invention to provide lamps which are identical in construction, thereby removing any possibility of error on the part of the installer. Further, by having only one type of lamp the manufacture and stocking of lamps is greatly simplified. Not only are the lamps identical, but the cables connecting the lamps are identical. The lamps are positioned on the gate arm, they are connected by the cables, and the first flashing lamp is connected to the output of the DC supply through the flasher relay. This particular construction removes any possible error in the installation of lamps on railroad gate arms.

In the structure of U.S. Pat. No. 4,666,108 it is necessary for the installer to experiment to insure correct positioning of the cable plugs. In the present invention, the plug openings and pins can only be joined in the correct manner.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad crossing gate arm electrical lamp system which provides two flashing lamps and one continuously operated lamp, each of said lamps having an internal electrical circuit therein, with the internal circuits being identical for each lamp, whereby the lamp are interchangeable in position with the lamp position determining its function, each lamp electrical circuit having a three-wire input connection and a three-wire output connection, the three-wire input connection of each lamp circuit including first, second and third terminals, with each first terminal being connected to a lamp light, the three-wire output connection of each lamp circuit including first, second and third terminals, with each first output terminal being connected to a lamp light, identical and reversible three-wire cables connecting the first flashing lamp with the second flashing lamp and the second flashing lamp with the continuously operated lamp, the three-wire input connection of the first flashing lamp adapted to be connected to line and common terminals of a power supply in which the common terminal is alternately connected to either one of the line terminals.

2. The electrical lamp system of claim 1 further characterized in that each internal electrical circuit connects the first input terminal with the third output terminal, the second input terminal with the first output terminal, and the third input terminal with the second output terminal.

3. The electrical lamp system of claim 1 further characterized in that each lamp includes a light, a lens, and a housing, with said lamp circuits and input and output connections being in said housing.

* * * * *